US005944369A

United States Patent [19]

Kapes

[11] Patent Number: 5,944,369

[45] Date of Patent: Aug. 31, 1999

[54] DOOR HANDLE RELEASE MECHANISM

[75] Inventor: Richard C. Kapes, Shelby Twp., Mich.

[73] Assignee: Chrysler Corporation, Auburn Hills, Mich.

[21] Appl. No.: 08/976,633

[22] Filed: Nov. 24, 1997

[51] Int. Cl.[6] ..... L05B 63/20

[52] U.S. Cl. ..... 292/336.3; 292/DIG. 25; 74/501.6

[58] Field of Search ..... 292/28, 38, 84, 292/125, 133, 169, 171, 141, 225, 235, 336.3, DIG. 25, DIG. 37, DIG. 46; 74/500.5, 501.6, 502, 502.6

[56] References Cited

U.S. PATENT DOCUMENTS

| | | | |
|---|---|---|---|
| 2,865,220 | 12/1958 | Bayley . | |
| 2,989,333 | 6/1961 | Fox | 292/DIG. 37 |
| 4,038,718 | 8/1977 | Reihac et al. | 16/110 |
| 4,232,565 | 11/1980 | Leonheart | 74/489 |
| 5,531,489 | 7/1996 | Cetnar | 292/225 |
| 5,558,372 | 9/1996 | Kapes | 292/336.3 |
| 5,681,068 | 10/1997 | Kleefeldt | 292/336.3 |
| 5,775,173 | 7/1998 | Wagner | 74/502.2 |

*Primary Examiner*—Darnell M. Boucher
*Assistant Examiner*—Gary Estremsky
*Attorney, Agent, or Firm*—William J. Coughlin

[57] ABSTRACT

A release mechanism for a vehicle door latch control assembly generally includes a base member, a camming member, and an actuator member. The base member is mounted to a frame of a sliding door. The actuator member is mounted to the base member for movement between first and second positions. The camming member includes first and second camming portions and is pivotally attached to the base member for rotation about a fixed axis in response to displacement of the actuator member. The first camming portion of the camming member is cooperatively arranged with the actuator member such that displacement of the actuator member rotates the camming member about its pivot axis. The second camming portion is operatively arranged with a cable which is connected to a latch control assembly for unlatching the door.

11 Claims, 4 Drawing Sheets

DOOR HANDLE RELEASE MECHANISM

BACKGROUND OF THE INVENTION

1. Field of the Invention

The present invention relates generally to a latching arrangement for a door. More particularly, the present invention relates to a release mechanism for a latching arrangement of a motor vehicle sliding door.

2. Discussion

Conventional motor vehicles include various types of doors mounted for movement between open and closed positions. Such doors are typically mounted for pivotal movement and include passenger doors, tailgates and liftgates. In addition, minivans and similar vehicles often include sliding side doors.

A wide variety of known latching arrangements are known for selectively retaining vehicle doors in their closed position. Most known latching arrangements for vehicles are specifically adapted to cooperate with pivotally mounted doors. One latching arrangement specifically adapted for a sliding vehicle door is shown and described in commonly assigned U.S. Pat. No. 5,558,372. The latching arrangement disclosed in U.S. Pat. No. 5,558,372 represents a significant advance over other known latching arrangements. However, certain aspects, including the manual effort required for latch actuation, are subject to even further improvement.

SUMMARY OF THE INVENTION

It is a principal object of the invention is to provide an improved release mechanism for a vehicle door latching arrangement.

It is a related object of the present invention to provide an improved release mechanism for a vehicle door latch assembly with improved manually effort for operation.

It is another object to provide a release mechanism for a door latching arrangement having a simple construction and reduced number of parts.

In one form, the present invention provides a release mechanism for a latch of a vehicle door. The release mechanism includes a base member attached to the vehicle door and a latch actuator cable. The release mechanism additionally includes an actuator member interconnected to the vehicle door for movement between a first position and a second position. The release mechanism further includes a camming member pivotally connected to the base member. The camming member has first and second lobes. The first lobe is juxtaposed in an operative relationship to the actuator member. The latch actuator cable interconnects the camming member and the latch. Movement of the actuator member causes rotation of the camming member so as to displace the latch actuator cable for actuating the latch.

Additional objects and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
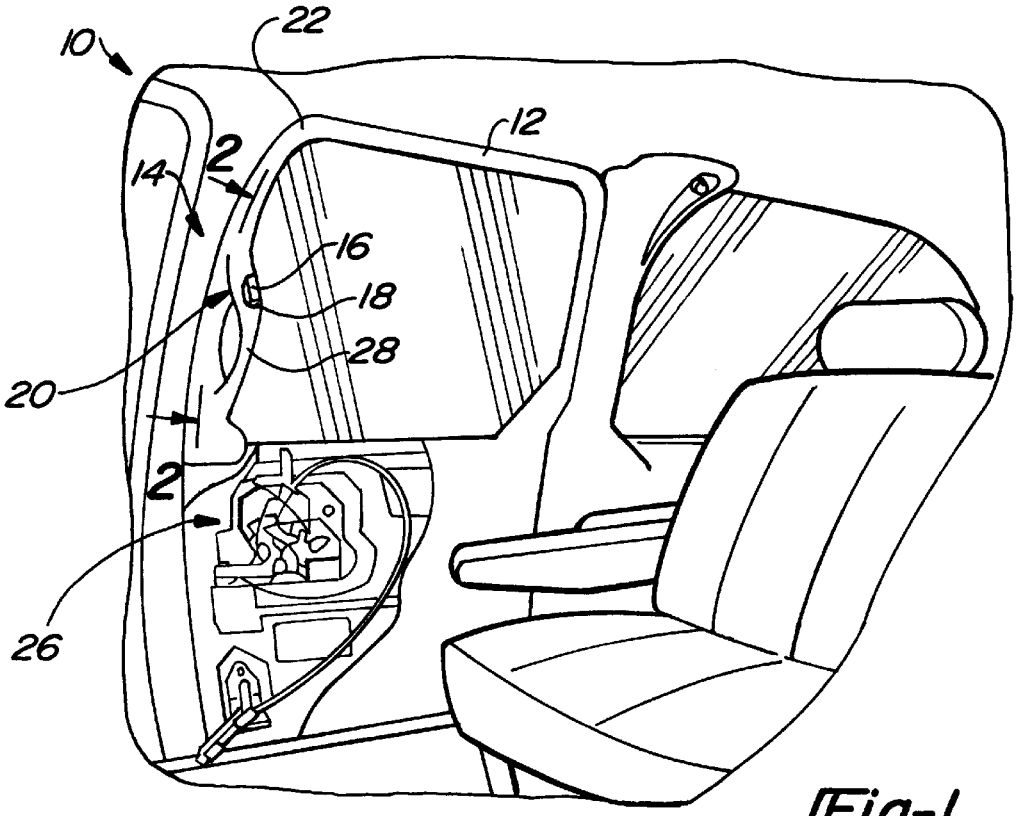
FIG. 1 is a fragmentary perspective view of a vehicle having a side sliding door incorporating a door handle release mechanism constructed in accordance with the teachings of the preferred embodiment of the invention.
Figure 5:
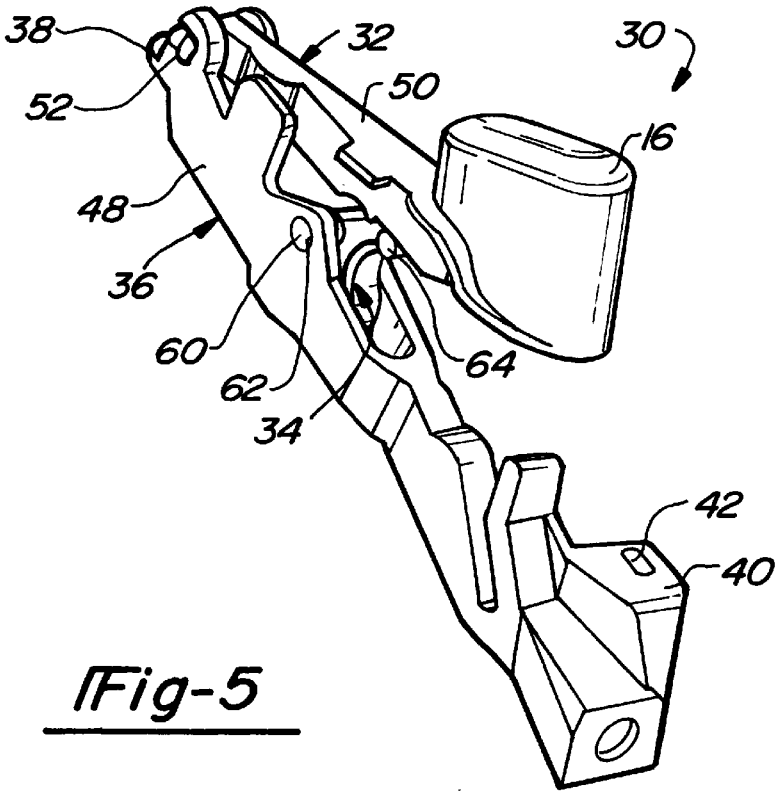
FIG. 5 is a perspective view of the door handle release mechanism of the present invention.
Figure 2:
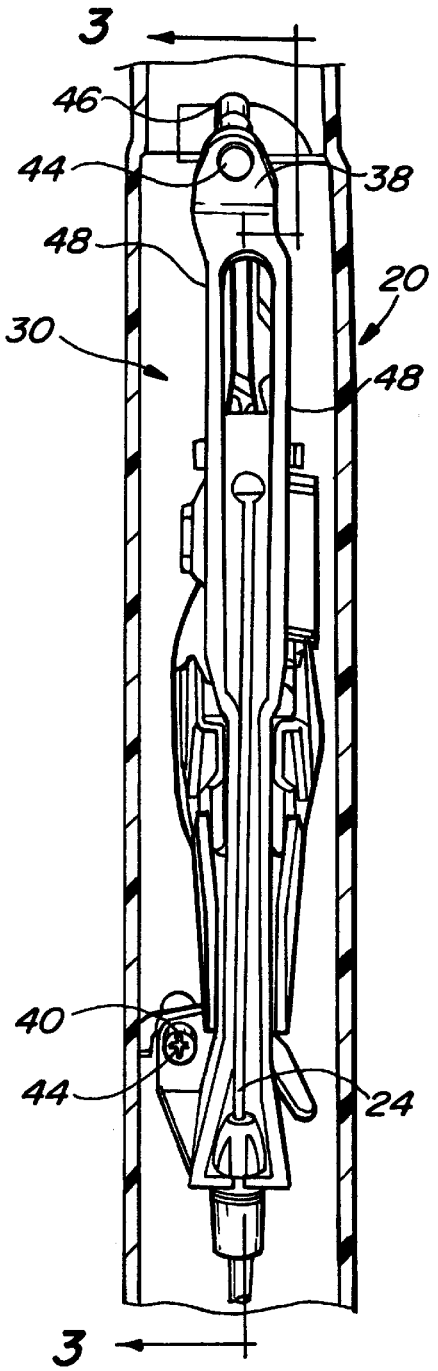
FIG. 2 is a cross-sectional view taken along the plane of the line 2—2 of FIG. 1 and looking in the direction of the arrows.

Referring now to the drawings in greater detail, FIG. 1 is an environmental view illustrating a vehicle body 10 having a right hand side sliding door 12 including a door latching mechanism 14. The latching mechanism 14 generally includes a thumb actuated release button 16 mounted so as to extend outwardly through an opening 18 formed in an inside handle section 20 mounted on a front side of a window frame 22. A latch actuator cable 24 extends from inside the handle 20 to a door latch control assembly 26. One suitable control assembly 26 is disclosed in commonly assigned U.S. Pat. No. 5,558,372, which is hereby incorporated by reference. A "grab" handle 28 is formed on the inside handle section 20 immediately below release button 16.

With reference to FIGS. 2–5, a release mechanism 30 constructed in accordance with the teachings of the preferred embodiment of the present invention is illustrated mounted inside the handle section 20. The release mechanism 30 is operative for selectively actuating the door latch control assembly 26 so as to allow the door 12 to slide open (to the right as shown in FIG. 1). It will be understood that the door latch control assembly 26 can also be operated from outside the vehicle by an outside handle (not shown) as described in U.S. Pat. No. 5,558,372. It will also be understood that the door latch control assembly 26 may be operated in a conventional manner by remote control.

The release mechanism 30 includes three molded parts that snap together. The parts consist generally of an actuator member 32 having the thumb button 16 integrally molded thereon, a camming member 34, and a mounting bracket or base member 36. The base member 36 is formed to include upper and lower mounting flanges 38 and 40 to facilitate attachment to the door 12. The upper and lower mounting flanges 38 and 40 are both formed to include an aperture 42 for receiving a fastener 44. The fasteners 44 engage molded abutments or boss portions 46. The base member 36 is further formed to include a pair of spaced apart side walls 48 which function in a manner described below to receive the camming member 34 and actuator member 32.

Figure 3:
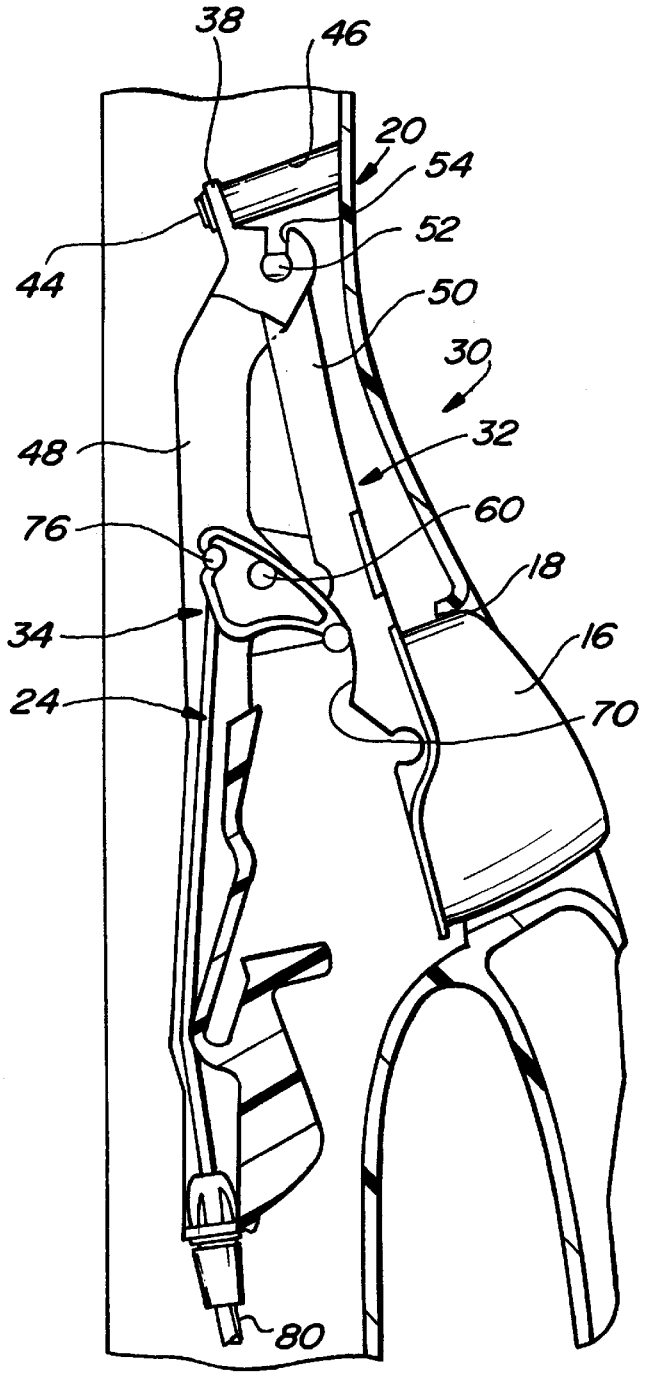
FIG. 3 is a cross-sectional view taken along the plane of the line 3—3 of FIG. 2 illustrating the door handle release mechanism of the present invention.
Figure 4:
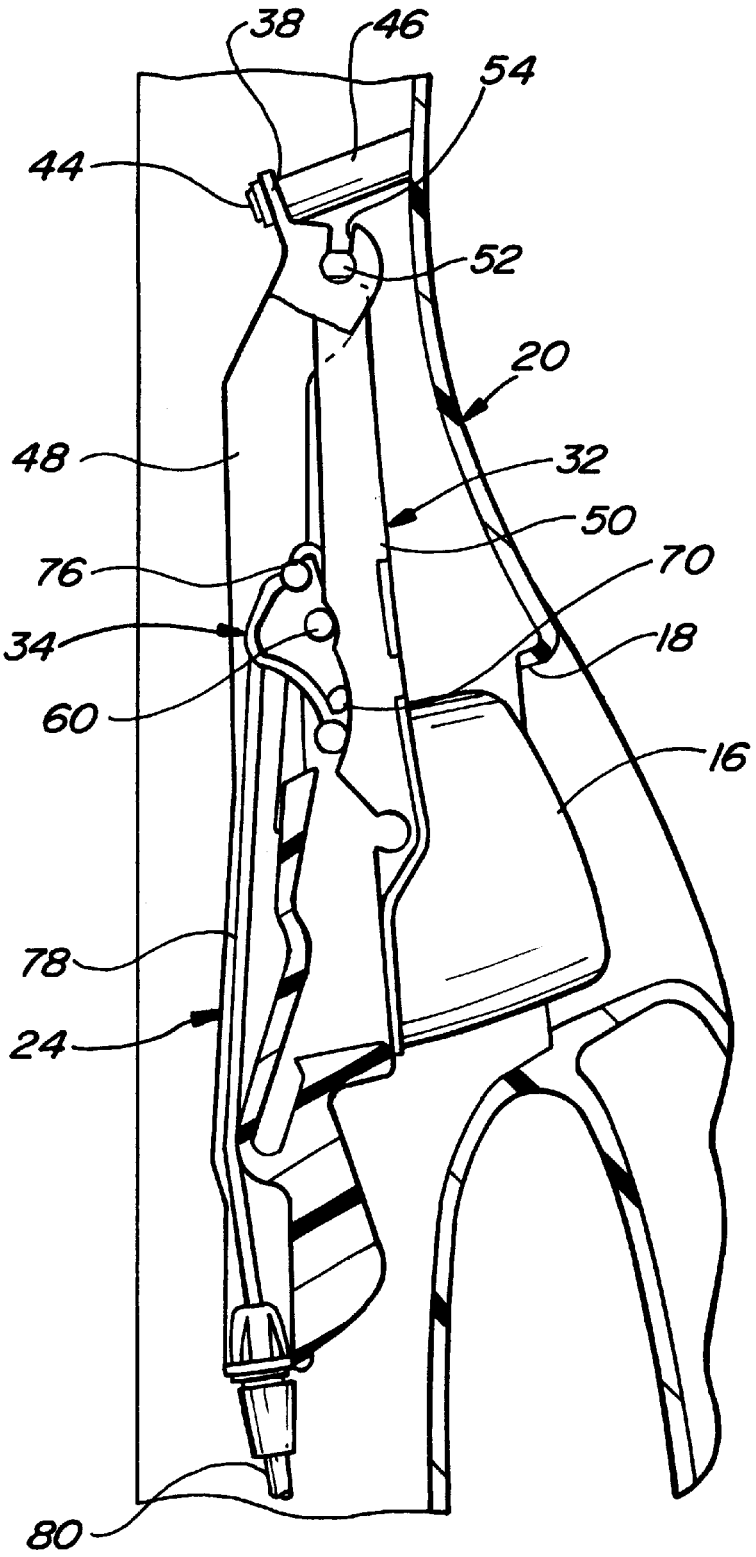
FIG. 4 is a view similar to FIG. 3, illustrating a different operational condition thereof.

The actuator mechanism 32 is shown to include the release button 16 which extends through the opening 18. The release button 16 is pivotally attached to the base member 36 through an arm 50. A pair of oppositely disposed, aligned studs 52 are formed on the distal end of the arm 50 and are adapted to snap into oppositely disposed, aligned slots 54 formed in an upper end of the base member 36. Once snapped together, the studs 52 and aligned channels 54 permit pivotal movement of the arm 50 about an axis defined by the studs 52. In this regard, the actuator mechanism 32 is rotatable between a first position in which the door 12 is latched (as shown in FIG. 3) and a second position in which the door is unlatched (as shown in FIG. 4). It will be appreciated by those skilled in the art that the actuator mechanism 32 may be alternatively mounted for linear movement.

Figure 6:
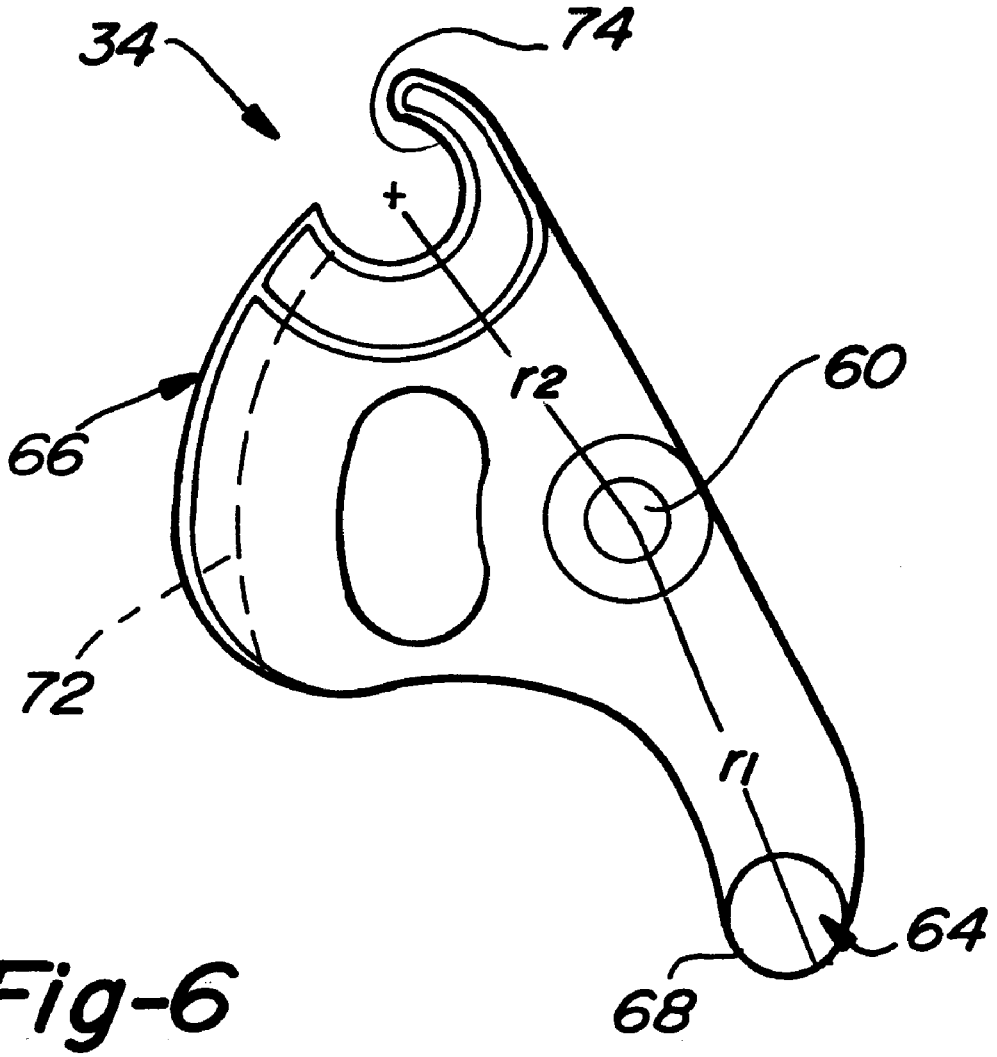
FIG. 6 is an enlarged side view of the camming member of the present invention shown removed from the release mechanism for purposes of illustration.

With particular reference to the enlarged side view of FIG. 6, the camming member 34 is shown to be integrally formed to include a horizontally extending pivot pin 60. The pivot pin 60 is rotatably received within aligned apertures 62 in the spaced apart side walls 48 of the base member 36. The pivot pin 60 defines a fixed axis about which the camming member 34 rotates.

The camming member 34 is formed to include first and second camming portions or lobes 64 and 66. The first lobe 64 is juxtaposed in an operative relationship to the actuator member 32 and preferably comprises a horizontally elongated cylindrical member. An outer contact surface 68 of the cylindrical member 64, which is spaced from the pivot axis defined by the pivot pin 60 a distance of $r_1$, cooperates with an arcuate surface 70 formed on an adjacent side of the arm 50 of the actuator member 32. More particularly, the contact surface 68 slides along the arcuate surface 70 as the actuator member 30 is rotated about the pivot axis defined by the aligned studs 52. As a result, the camming member 34 is rotated about its pivot axis.

The second lobe 66 is shown to include an arcuate channel 72 formed in a side of the camming member 34. The arcuate channel 72 terminates adjacent to a slot 74 adapted to receive and retain an end 76 of the latch actuator cable 24. The latch actuator cable 22 is a bowden-type cable having an inner cable proper 78 and an exterior sheath 80. The center of the slot 74 is spaced apart from the pivot axis defined by the pivot pin 60 a distance of $r_2$. The arcuate channel 72 receives the cable 22 as the actuator mechanism 32 is moved between the first position (shown in FIG. 3) and the second position (shown in FIG. 4) to upwardly displace a lower end (not specifically shown) of the cable 22.

In one application, the distance $r_1$ is approximately 20 mm. In this application, the distance $r_2$ is approximately 17 mm and the upward displacement of the cable 24 in response to rotation of the camming member 34 is approximately 19.28 mm. It will be appreciated by those skilled in the art that these dimensions have proven satisfactory for an exemplary application and may be modified for other applications within the scope of the present invention.

In operation, depressing the thumb button 16 of the actuator mechanism 32 (as shown in FIG. 4) rotates the camming member 34 about the pivot axis defined by the pivot pin 66 (clockwise as shown in the drawings). The cable 22 is upwardly displaced by virtue of its connection in the slot 74 in the camming member 34. The lower end (not shown) of the cable 22 unlatches the latch mechanism 26, thereby permitting the door 12 to be opened.

It should be apparent that the invention provides a simplified, compact and efficient door latch release mechanism 30, with three molded parts thereof easily snapped together for pivotal operation therebetween, and readily available on the door frame to the vehicle passenger.

While the above description constitutes the preferred embodiment of the invention, it will be appreciated that the invention is susceptible to modification, variation, and change without departing from the proper scope or fair meaning of the accompanying claims. For example, it will be apparent to those skilled in the art that the present invention is adaptable to being constructed as either a left hand or right hand arrangement for use on a left or right door, respectively.

We claim:

1. A release mechanism and a vehicle door in combination, the vehicle door including a latch, the release mechanism comprising:

an actuator member pivotable about a first axis between a first position and a second position for unlatching the latch;

a camming member having first and second lobes, said first lobe juxtaposed in a slidable cam relationship to said actuator member a latch actuator cable having a first end attached to the latch and a second end attached to said camming member; and a mounting bracket attached to the door, said actuator member and said camming member being pivotally attached to said mounting bracket;

said camming member rotatable in a first direction about a second axis that is parallel to said first axis and is fixed with respect to said mounting bracket, when said actuator member is moved from said first position to said second position;

whereby movement of said actuator member causes rotation of said camming member to displace said latch actuator cable with said second lobe for actuating the latch.

2. The release mechanism for a latch of a vehicle door of claim 1, wherein said actuator member includes an arcuate surface and said first lobe comprises a generally cylindrical portion adapted to slide along said arcuate surface as said actuator member is moved from said first position to said second position.

3. The release mechanism for a latch of a vehicle door of claim 1, wherein said second lobe includes an arcuate recess for receiving said cable as said camming member is rotated.

4. The release mechanism for a latch of a vehicle door of claim 1, further comprising a base member attached to the vehicle door, said actuator member and said camming member being pivotally attached to said base member.

5. An apparatus for actuating a latch of a sliding door of a motor vehicle having a frame in combination with the sliding door, the apparatus comprising:

an inside grab handle attached to the sliding door;

a release mechanism mounted substantially within said inside grab handle, said release mechanism including:

an actuator member movable between a first position and a second position for unlatching the latch;

a camming member having first and second lobes, said first lobe juxtaposed in a slidable cam relationship to said actuator member, said second lobe juxtaposed in an operative relationship with said latch actuator cable;

a latch actuator cable having a first end attached to the latch and a second end attached to said camming member; and a mounting bracket attached to the door, said actuator member and said camming member being pivotally attached to said mounting bracket to rotate about parallel fixed axis;

said camming member rotatable in a first direction in response to movement of said actuator member from said first position to said second position;

whereby movement of said actuator member causes rotation of said camming member to displace said latch actuator cable for actuating the latch.

6. The apparatus for actuating a latch of a sliding door of a motor vehicle of claim 5, wherein said camming member includes a recess for receiving an end of said latch actuator cable.

7. The apparatus for actuating a latch of a sliding door of a motor vehicle of claim 6, wherein said actuator member includes an arcuate surface and said first lobe comprises a generally cylindrical portion adapted to slide along said arcuate portion as said actuator member is moved from said first position to said second position.

8. The apparatus for actuating a latch of a sliding door of a motor vehicle of claim 6, wherein said second lobe includes an arcuate recess for receiving said cable as said camming member is rotated.

9. A latching arrangement for a sliding door of a motor vehicle in combination with the motor vehicle, the motor vehicle having a body, the latching arrangement comprising:

a latch control assembly for selectively latching the sliding door with the body of the motor vehicle; and a release mechanism for operating said latch control assembly, said release mechanism including:

an actuator member movable between a first position and a second position for unlatching the latch;

a camming member having first and second lobes, said first lobe juxtaposed in a slidable cam relationship to said actuator member, said second lobe juxtaposed in an operative relationship with said latch actuator cable;

a latch actuator cable having a first end attached to the latch and a second end attached to said camming member; and a mounting bracket attached to the door, said actuator member and said camming member being Pivotally attached to said mounting bracket;

said camming member rotatable in a first direction when said actuator member is moved from said first position to said second position;

whereby movement of said actuator member causes rotation of said camming member to displace said latch actuator cable for operating said latch control assembly.

10. The latching arrangement for a sliding door of a motor vehicle of claim 9, wherein said actuator member includes an arcuate surface and said first lobe comprises a generally cylindrical portion adapted to slide along said arcuate portion as said actuator member is moved from said first position to said second position.

11. The latching arrangement for a sliding door of a motor vehicle of claim 9, wherein said second lobe includes an arcuate recess for receiving said cable as said camming member is rotated.

* * * * *